US009533409B2

(12) United States Patent
Buchanan

(10) Patent No.: US 9,533,409 B2
(45) Date of Patent: Jan. 3, 2017

(54) EXTENDABLE WRENCH HANDLES

(71) Applicant: Nigel Alexander Buchanan, Fife (GB)

(72) Inventor: Nigel Alexander Buchanan, Fife (GB)

( * ) Notice: Subject to any disclaimer, the term of this patent is extended or adjusted under 35 U.S.C. 154(b) by 320 days.

(21) Appl. No.: 14/456,315

(22) Filed: Aug. 11, 2014

(65) Prior Publication Data

US 2014/0345428 A1 Nov. 27, 2014

Related U.S. Application Data

(63) Continuation of application No. PCT/GB2013/000053, filed on Feb. 11, 2013.

(30) Foreign Application Priority Data

Feb. 11, 2012 (GB) ..... 1202422.0

(51) Int. Cl.

| | |
|---|---|
| ***B25G 1/04*** | (2006.01) |
| ***B25B 23/16*** | (2006.01) |
| ***B25B 13/04*** | (2006.01) |
| ***B25B 13/08*** | (2006.01) |
| ***B25B 13/46*** | (2006.01) |

(52) U.S. Cl.

CPC ..... *B25G 1/043* (2013.01); *B25B 13/04* (2013.01); *B25B 13/08* (2013.01); *B25B 13/46* (2013.01); *B25B 23/16* (2013.01)

(58) Field of Classification Search

CPC ..... B25B 13/04; B25B 13/08; B25B 13/481; B25B 23/16; B25B 23/0007; B25G 1/04; B25G 1/043; B25G 1/06

See application file for complete search history.

(56) References Cited

U.S. PATENT DOCUMENTS

| | | | | |
|---|---|---|---|---|
| 2,382,291 | A | 8/1945 | Carlberg | |
| 2,438,633 | A | 3/1948 | Condor | |
| 2,869,410 | A | 1/1959 | Prichard | |
| 4,070,932 | A | 1/1978 | Jeannotte | |
| 4,376,397 | A | 3/1983 | Newby et al. | |
| 4,440,517 | A | 4/1984 | Potter et al. | |
| 5,570,617 | A | 11/1996 | Love | |
| 6,370,990 | B1 * | 4/2002 | Lin | B25B 13/04 81/177.2 |
| 6,691,595 | B2 * | 2/2004 | Hsien | B25B 13/04 16/113.1 |
| 7,322,264 | B2 * | 1/2008 | Hu | B25B 13/04 81/177.2 |
| 2010/0175514 | A1 * | 7/2010 | Hsieh | B25B 13/08 81/177.2 |
| 2012/0204686 | A1 * | 8/2012 | Carlson | B25B 13/04 81/479 |

FOREIGN PATENT DOCUMENTS

| | | |
|---|---|---|
| GB | 2 400 812 | 10/2004 |
| WO | WO 2010/067356 A2 | 6/2010 |

* cited by examiner

*Primary Examiner* — David B Thomas
(74) *Attorney, Agent, or Firm* — Woodard Emhardt Moriarty McNett & Henry LLP

(57) ABSTRACT

A wrench has a wrench head, an extendable shaft and a shaft locking device. The extendable shaft has a first shaft portion that extends from the wrench head and a second shaft portion that telescopes with respect to the first shaft portion. The locking device is configured to be movable inwardly of the extendable shaft from a locking condition to a release condition in which telescoping of the second shaft portion is permitted.

20 Claims, 5 Drawing Sheets

EXTENDABLE WRENCH HANDLES

CROSS-REFERENCE TO RELATED APPLICATIONS

This application is a continuation of PCT/GB2013/000053 filed Feb. 11, 2013 which claims priority to GB 1202422.0 filed Feb. 11, 2012, both of which are hereby incorporated by reference.

FIELD OF THE INVENTION

The invention relates to extendable wrench handles.

BACKGROUND TO THE INVENTION

A wrench may comprise a wrench head, which may be configured to directly engage a workpiece or a socket that engages the workpiece, and handle connected with the wrench head to permit a user to apply a torque to the workpiece via the wrench head. Typically, the handle has a set length, particularly where the wrench has an open ended or ring wrench head that directly engages the workpiece. It may be desirable to provide a wrench with a handle whose length can be varied. Such a handle may be used in an extended condition to make it easier to applier higher levels of torque to the workpiece and used in a contracted condition where higher levels of torque are not needed or there is insufficient space to permit use in the extended condition.

SUMMARY

The invention provides a wrench comprising a wrench head, an extendable shaft and a shaft locking device, wherein said extendable shaft comprises a first shaft portion that extends from said wrench head and a second shaft portion that telescopes with respect to said first shaft portion and said locking device is configured to be movable inwardly of said extendable shaft from a locking condition to a release condition in which telescoping of said second shaft portion is permitted.

The invention also includes a wrench comprising a wrench head, an extendable shaft and a shaft locking device, wherein said extendable shaft and shaft locking device are configured to permit substantially continuous length adjustment of the extendable shaft over an adjustment range defined by a lengthways extending aperture of the extendable shaft. The extendable shaft may comprise a first shaft portion extending from said wrench head and a second shaft portion and the lengthways extending aperture may be provided in said second shaft portion. The shaft locking device may be configured to be moved inwardly of the extendable shaft in a direction substantially perpendicular to a longitudinal axis of said shaft to release said extendable shaft from a locked condition and permit extension and contraction of the extendable shaft. The shaft locking device may comprises a cylindrical member having a series of teeth extending around the circumference thereof and engageable with two oppositely disposed sets of teeth provided on the second shaft portion to lock said extendable shaft in a desired length condition. The teeth of the cylindrical member may engage the two oppositely disposed sets of teeth simultaneously. The second shaft portion may comprise inner and outer sleeves arranged coaxially. The inner and outer sleeves may define a laminate structure. The second shaft portion may comprise two sleeve halves clamped to one another and provided with end stops to retain the shaft locking device.

The invention also provides a method comprising providing a wrench head with a first shaft portion extending from the wrench head, a second shaft portion arranged to telescope with respect to the first shaft portion and a user actuable shaft locking device to lock the second shaft portion in a desired position relative to the first shaft portion, wherein the second shaft portion comprises at least one sleeve formed by stamping and folding a metal sheet. The second shaft portion may comprise an inner and outer said sleeve arrange coaxially with an outer periphery of the inner sleeve engaging an inner periphery of the outer sleeve to define a laminate structure. The inner sleeve may comprise a slot that extends between opposite ends of the inner sleeve. The inner sleeve slot has opposed lengthways extending sides that may be provided with respective sets of teeth or similar locking formations engagable by the shaft locking device. The outer sleeve may have a lengthways extending seam disposed opposite and spaced apart from the inner slot sleeve so that the seam abuts a contiguous surface of the inner sleeve. The respective edges of the seam may be joined by welding, for example, by a substantially continuous seam weld.

Further forms, objects, features, aspects, benefits, advantages, and embodiments of the present invention will become apparent from a detailed description and drawings provided herewith.

BRIEF DESCRIPTION OF THE DRAWINGS

In order that the invention may be well understood, examples thereof, which are given by way of example only, will now be described with reference to the drawings in which.

DESCRIPTION OF THE SELECTED EMBODIMENTS

Figure 1:
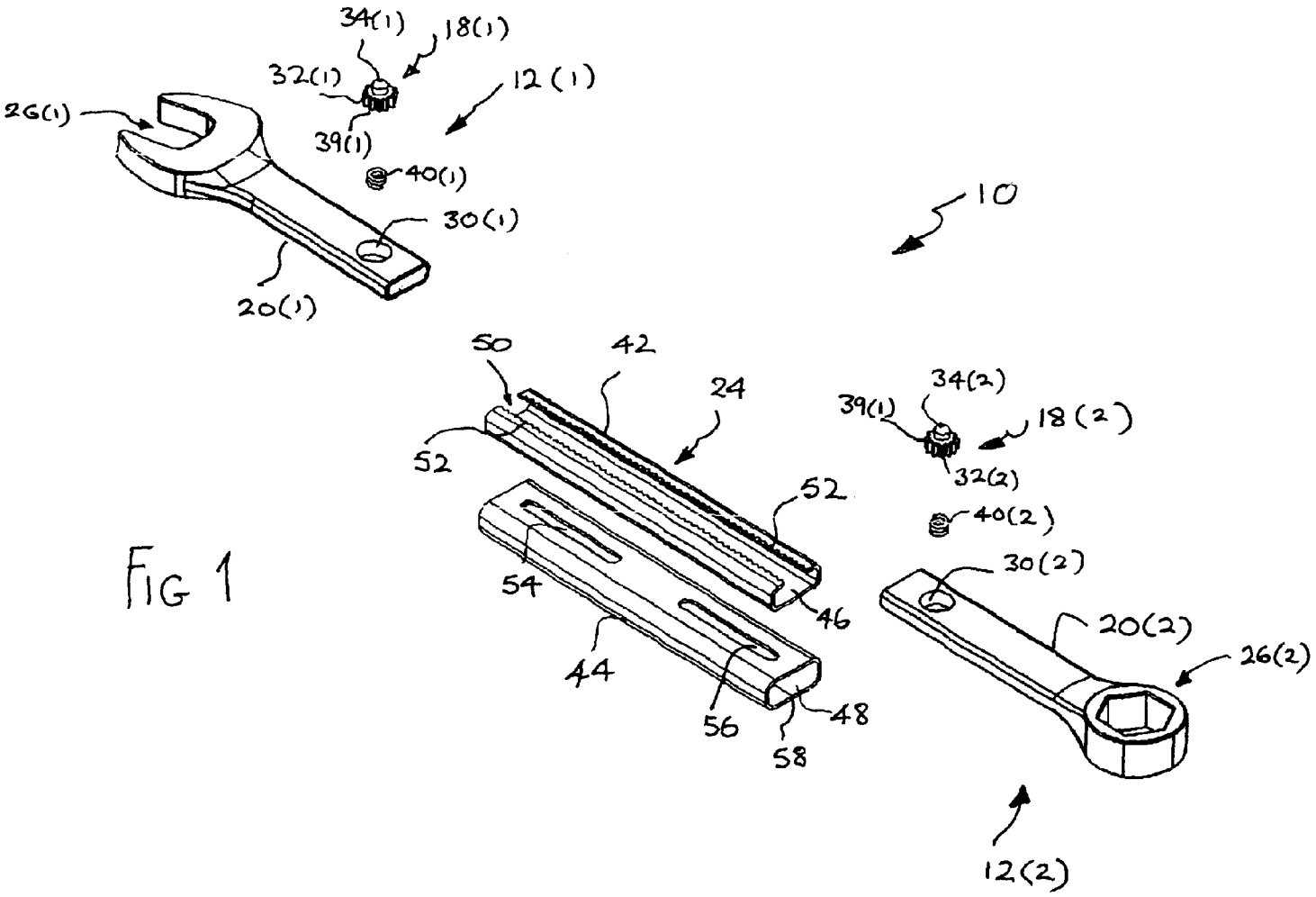
FIG. 1 is an exploded perspective view of a wrench according to an exemplary embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Referring to FIGS. 1 to 7, a wrench 10 comprises a first wrench head 12(1), second wrench head 12(2), an extendable shaft 14 (FIG. 2), a first locking device 18(1) and a second locking device 18(2). The extendable shaft 14 comprises respective first shaft portions 20(1), 20(2) that extend from the first wrench head 12(1), 12(2) and a second shaft portion 24 that telescopes with respect to the first shaft portions. The first and second locking devices 18(1), 18(2) are configured to be movable inwardly of the extendable shaft 16 from a locking condition to a release condition in which telescoping of the second shaft portion 24 is permitted. In the illustrated example, there are two wrench heads 12(1), 12(2) with respective first shaft portions and locking devices. In other examples, there may be just one wrench head or one wrench head may be fixed to the second shaft portion.

The wrench heads 12(1), 12(2) each comprise an opening 26(1), 26(2) configured to directly engage a workpiece to apply a torque to the workpiece. The openings 26(1), 26(2) may be open ended or closed as shown in FIG. 1 and configured to receive a particular size of fastener or fastener head. In the illustrated example, one opening 26(1) is open ended and the other 26(2) is closed. In other examples with two wrench heads, both openings may be open or closed.

Apart from the configuration of the openings 26(1), 26(2), the structure of the wrench heads 12(1), 12(2) and the respective locking devices 18(1), 81(2) and the way they interact corresponds, so for economy of presentation, only wrench head 12(1) and locking device 18(1) will be referred to in the detailed description that follows.

Figure 7:
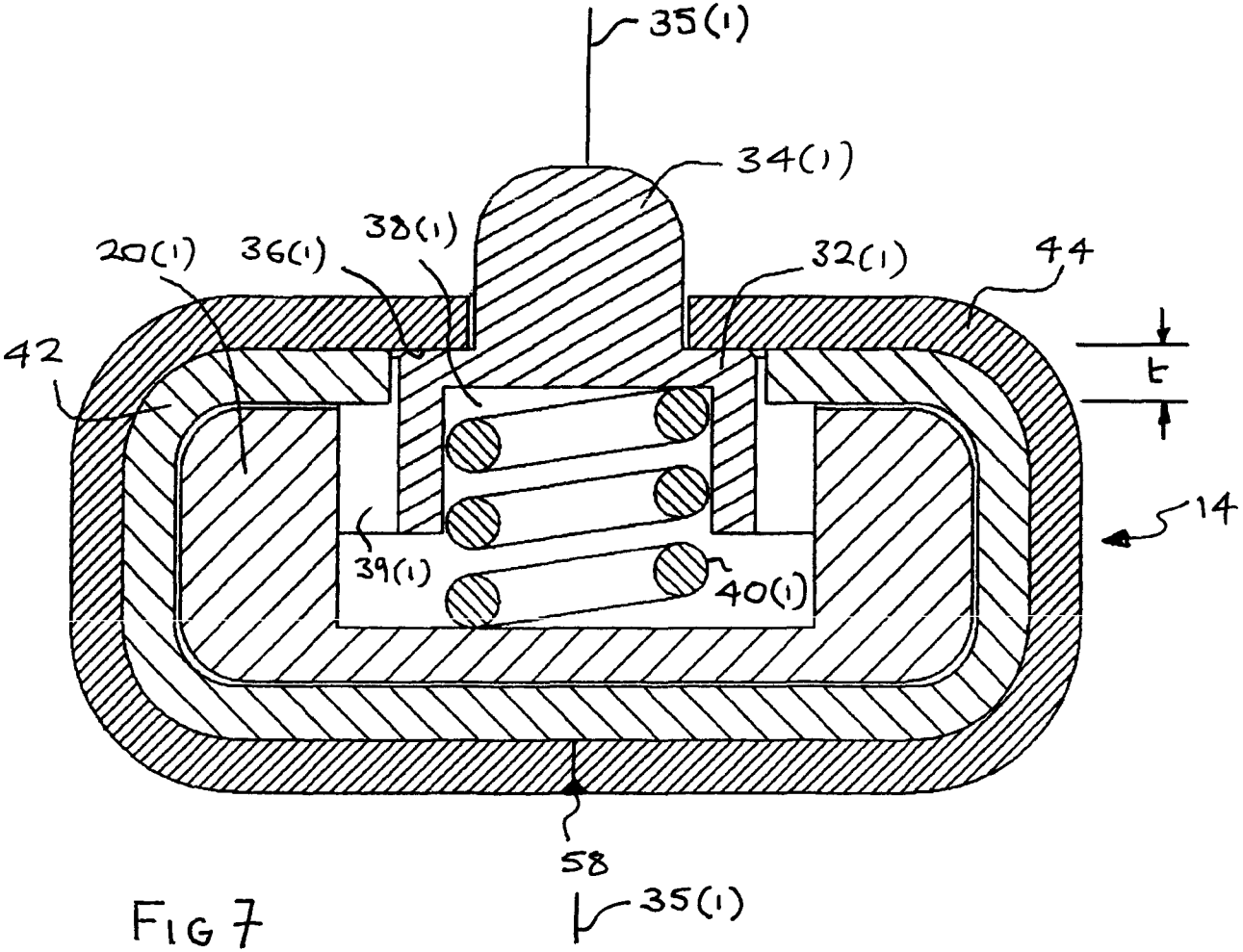
FIG. 7 is a section view on line VII-VII in FIG. 3.

The wrench head 12(1) is a solid member that may be formed by drop forging. The first shaft portion 20(1) is an integral part of the first wrench head is provided with a housing for the locking device 18(1) in the form of a circular recess 30(1). The locking device 18(1) comprises a cylindrical locking portion 32(1) and an actuator portion 34(1). As best seen in FIG. 7, the locking device 18(1) has a longitudinal axis 35(1) that defines a lengthways direction of the locking device. The locking portion 32(1) has a larger diameter than the actuator portion 34(1) whereby a shoulder 36(1) is defined at the intersection between the locking portion and the actuator portion. The locking portion (32(1) includes a recess 38(1) to receive an end of a biasing member, which in the illustrated example takes the form of a compression spring 40(1). The outer periphery of the locking portion 32(1) is provided with locking formations in the form of a series of teeth 39(1) that extends around the circumference of the locking portion.

The second shaft portion 24 comprises an inner sleeve 42 and an outer sleeve 44. The inner sleeve 42 is substantially rectangular in cross-section and defines an axially extending through-hole 46 that is configured to receive the first shaft portion 20(1). The outer sleeve 44 is substantially rectangular in cross-section and has an axially extending through-hole 48 that is configured to receive the inner sleeve 42. The inner sleeve is secured to the outer sleeve by, for example, spot welding or gluing.

As best seen in FIG. 7, the cross-section shapes of first shaft portion 20(1), the through-hole 46 and the through-hole 48 are complementary so that the inner sleeve 42 is a close fit in the through-hole 48 and while the first shaft portion 20(1) can slide in the axial direction of the through-hole 46, the fit is such that there is minimal relative transverse movement between the inner sleeve and first shaft portion. Accordingly, as shown in FIG. 7, the extendable shaft 14 has a pseudo-laminate structure in the regions in which the first shaft portion and second shaft portion engage making for a relatively strong structure.

The inner sleeve 42 is provided with a lengthways extending slot 50 in one side that in the illustrated example extends along the entire length of the sleeve. The opposed edges of the slot are provided with respective sets of locking formations in the form of teeth 52 that are configured to be engageable with the teeth 39(1) of the locking device 18(1). It is not essential that the slot 50 extends over the entire length of the inner sleeve 42. However, the configuration illustrated in FIG. 1 may be formed by stamping a rectangular blank with teeth along two oppositely disposed edges and folding the blank to form a sleeve.

The outer sleeve 44 has respective slots 54, 56 for the first and second locking devices 18(1), 18(2). The slots 54, 56 extend in the axial (lengthways) direction of the outer sleeve and are configured such that when the inner sleeve is housed in the outer sleeve they are disposed over and extend parallel to the slot 50 of the inner sleeve. The outer sleeve 44 may be formed my stamping a rectangular blank with the slots 54, 56 extending along a centreline of blank and then folding the blank to form the sleeve. Where opposed edges of the blank meet along one side of the outer sleeve, they may be joined together with a seam weld 58. In the illustrated example, the outer sleeve is configured so that the longitudinally extending seam is disposed on the opposite side of the second shaft portion 24 to the slot 50 so that it abuts a contiguous surface of the inner sleeve. Accordingly, forces tending to drive the two sets of teeth 52 apart, thereby widening the slot, will be resisted by a contiguous U-section portion of the outer sleeve rather than the weld seam 58.

Figures 2, 3:
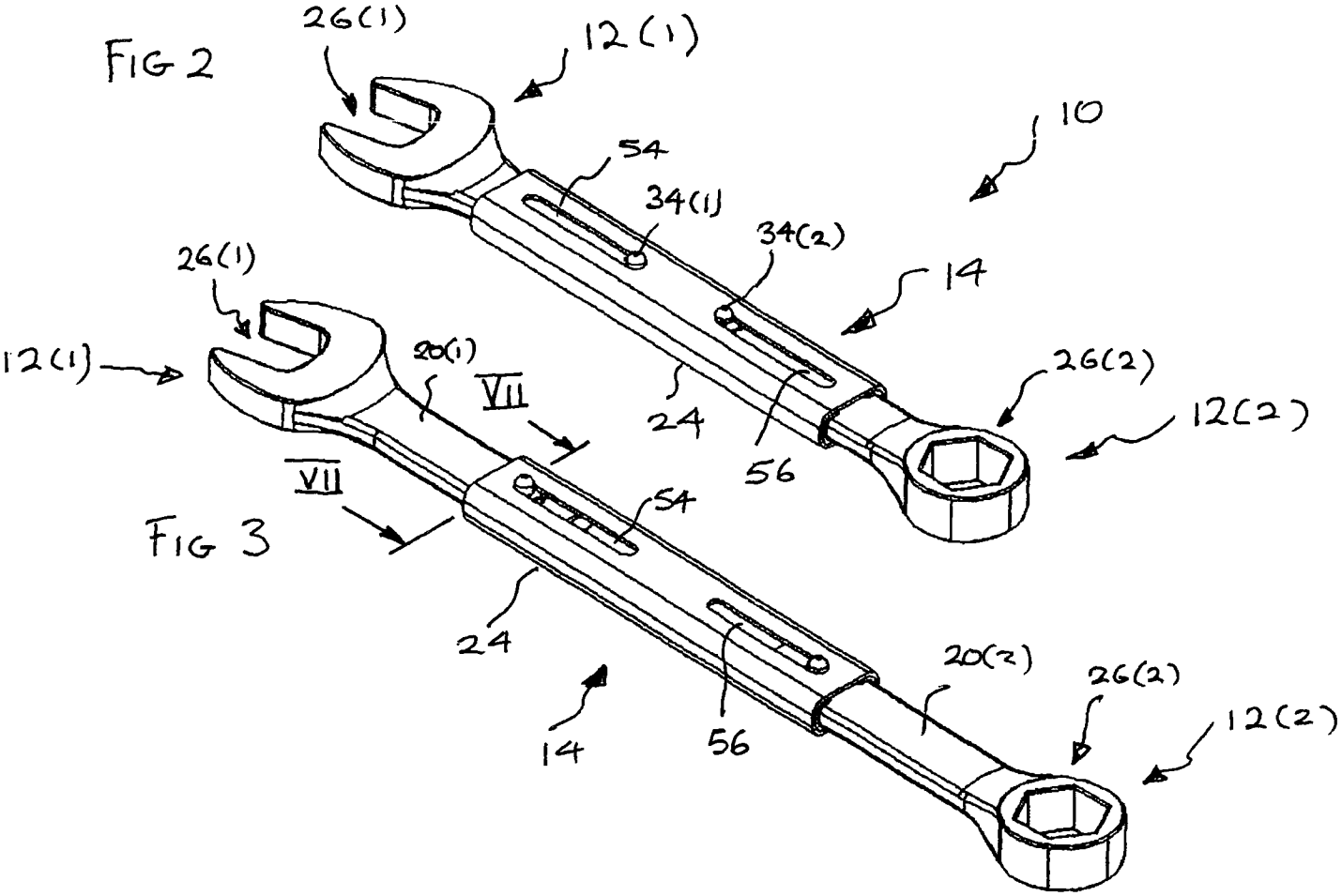
FIG. 2 is a perspective view showing the wrench of FIG. 1 in a contracted condition.
FIG. 3 is a perspective view showing the wrench of FIG. 1 in an extended condition.
Figure 5:
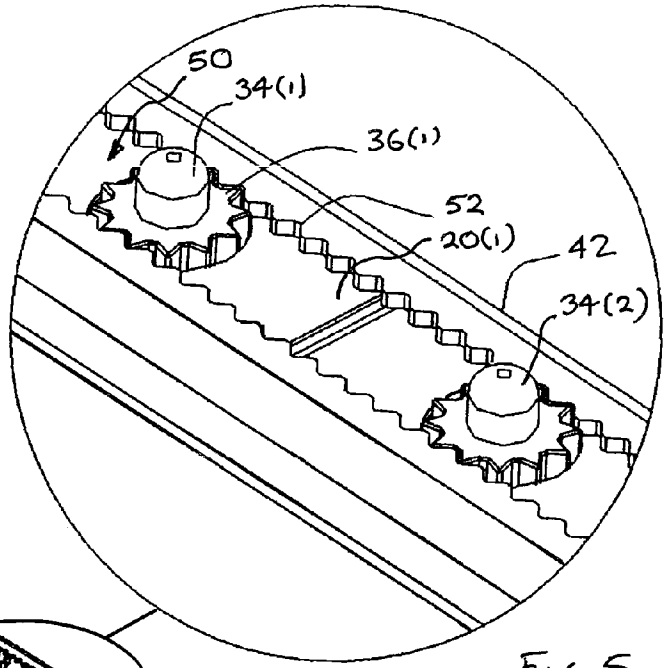
FIG. 5 is an enlargement of a portion of FIG. 4.
Figure 4:
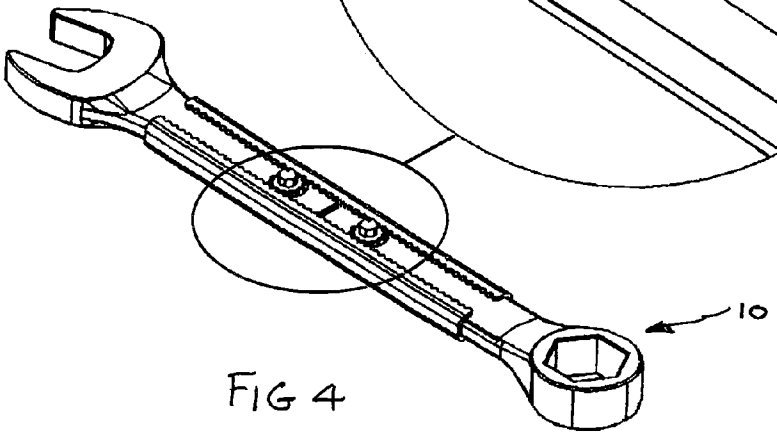
FIG. 4 is a perspective view corresponding to FIG. 2 with a part removed to reveal interior components of the wrench.

If a user wishes to extend the extendable shaft 14 from the contracted position shown in FIG. 2 to an extended condition as shown in FIG. 3, the actuator portion of the locking device 18(1) is pressed inwardly of the shaft to disengage the teeth 39(1) from the teeth 52 of the inner sleeve. The recess 30(1), locking portion 32(1) and spring 40(1) are configured such that the locking device can move inwardly of the extendable shaft by a distance that is at least the thickness t (FIG. 7) of the wall of the inner sleeve 42 that is provided with the teeth 52 to ensure disengagement of the teeth 39(1), 52. Once the teeth 39(1), 52 have disengaged, the wrench head 12(1) can move axially outwardly of the second shaft portion 24 to an extended position, such as the position shown in FIG. 3. Once the wrench head 12(1) is in desired position, the user can may release the actuator portion 34(1) of the locking device 18(1). Once the actuator portion 18(1) is released, the compression spring 40(1) drives the locking device 18(1) outwardly of the second shaft portion to bring the teeth 39(1) into engagement with the teeth 52 of the inner sleeve 42. The outward movement of the locking device 18(1) is limited by engagement of the shoulder 36(1) with the outer sleeve 44. Once the teeth 39(1), 52 are engaged, relative axial movement of the first shaft portion 20(1) and second shaft portion is prevented thereby locking the extendable shaft 14 in an extended condition.

Due to the continuous nature of the series of teeth 52 along the sides of the slot 50, the locking device 18(1) can lock the wrench head 12(1) at any position along a length defined by the slot 54 in the outer sleeve 44. Thus, the extendable shaft 14 can be locked in a substantially continuous range of positions over a length defined by the slot 54. In FIG. 2 the wrench 10 is shown with the extendable shaft 14 in a fully contracted condition with the actuator portions 34(1), 34(2) of the locking devices 18(1), 18(2) disposed at the innermost ends of their respective slots 54, 56. In FIG. 3, the extendable shaft 14 is shown in a fully extended condition with the actuator portions 34(1), 34(2) disposed at the opposite, outer, ends of their respective slots.

Figure 6:
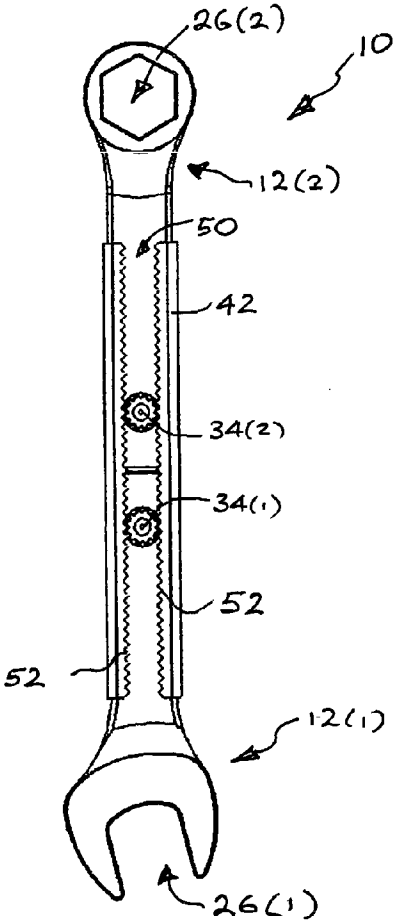
FIG. 6 is a plan view showing the wrench of FIG. 1 in a contracted condition with a part removed to reveal interior components of the wrench.

With reference to FIGS. 6 and 7, it can be seen that when in the contracted condition, the extendable shaft 14 comprises a substantially solid body so that the strength of the shaft should be little different to that of a solid shaft that is integral with the two wrench heads.

Figures 8, 9:
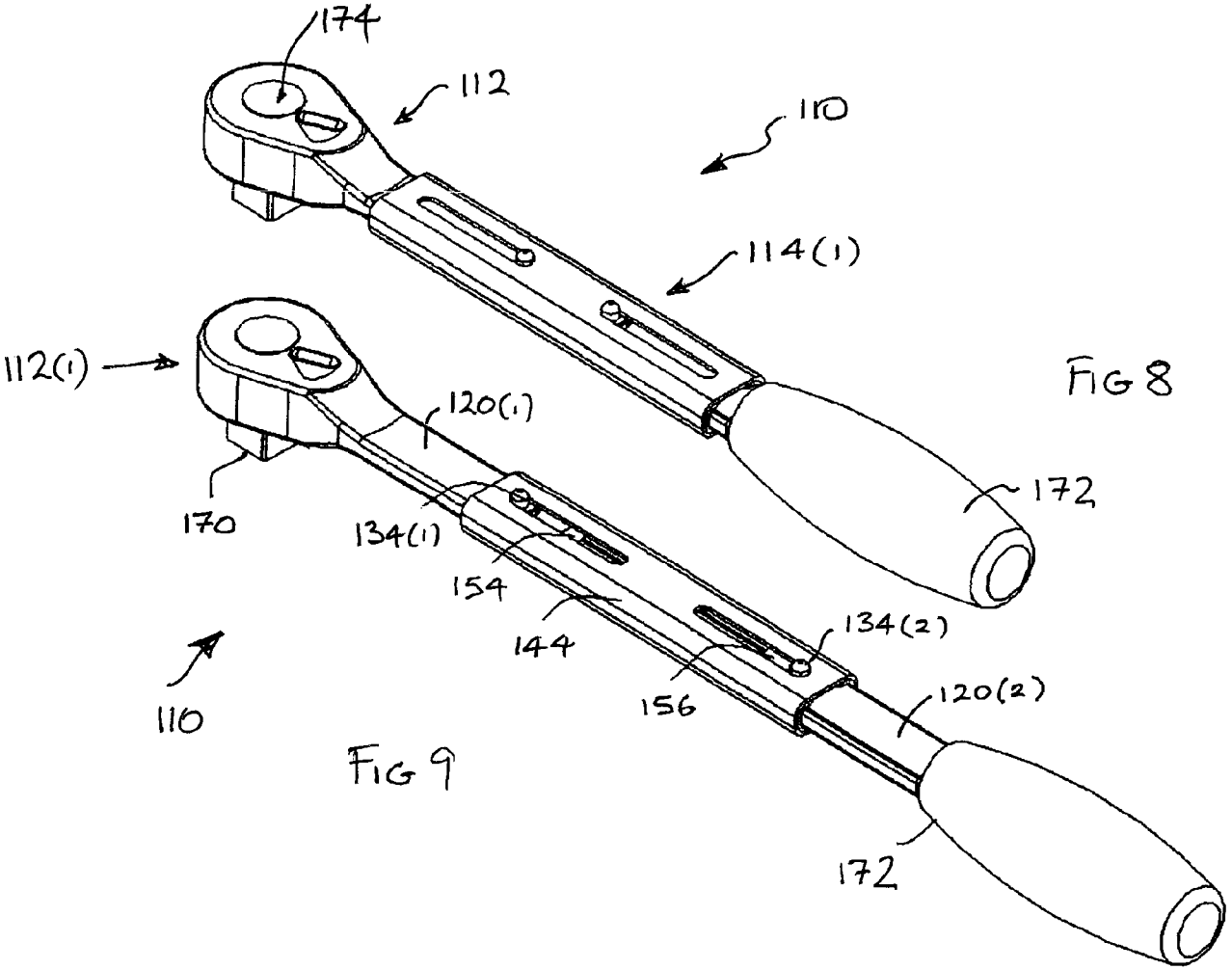
FIG. 8 is a perspective view showing a ratchet wrench handle in a contracted condition.
FIG. 9 is a perspective view showing the ratchet wrench handle of FIG. 8 in an extended condition.

Referring to FIGS. 8 and 9 a wrench 110 comprises a wrench head 112 and an extendable shaft 114. Instead of having a wrench head with an opening to directly engage a workpiece as in the wrench 10, the wrench head 112 has a formation 170 that can be used to engage a complementary formation of a workpiece engaging member such as a socket. In the illustrated example, the formation 170 is a rectangular lug that projects from the wrench head 112 to engage in a complementary opening in a socket (not shown). Although not essential, the extendable shaft 114 is extendable at both ends. However, instead of a second wrench head as in the example shown in FIG. 1, there is simply a shaft portion 120(2) that may be provided with a grip, such as a rubber grip 172. The wrench head 112 may be provided with a ratchet mechanism 174. The configuration of the wrench 110 is otherwise the same as the wrench 10 and so like or similar parts are indicated by the same reference numerals incremented by 100 and will not be described again.

In some examples, a low friction bearing portion may be incorporated in the extendable shaft to facilitate the relative sliding movement of the parts.

The components of the described examples of a second shaft portion can be formed relatively economically by a fabrication process that may involve metal stamping and joining of parts by welding of gluing. This allows the production of a relatively complex profile that would be difficult to manufacture by machining processes and other manufacturing methods In some examples, the second shaft portion may comprise a single sleeve comprising two sleeve halves that define respective sets of locking formations and provided with respective collars at the ends thereof that retain the locking devices in the second shaft portion and clamp the two halves together. Additionally clamping, for example by means of one or more clamping bands, may be provided at positions intermediate the ends of the second shaft portion.

The components of the described examples of a second shaft portion can be formed relatively economically by a fabrication process that may involve metal stamping and joining of parts by welding of gluing. This allows the production of a relatively complex profile that would be difficult to manufacture by machining processes and other manufacturing methods.

The provision of series of opposed teeth on the second shaft portion allows for a substantially continuous adjustment of the length of the extendable shaft in increments determined by the tooth size.

Although not essential, the locking device(s) have a cylindrical locking portion with a series of teeth around its entire circumference. This configuration reduces the need for careful alignment of the teeth making it easier for the user to extend and contract the extendable shaft.

In some examples, further extension of the extendable shaft may be obtained by providing a further second shaft portion and an extension bar. The extension bar may have respective housings for shaft locking devices corresponding to the shaft locking devices 18, 118 and the further second shaft portion may be substantially identical to the second shaft portions 24, 124. With reference to FIG. 1, the first shaft portion 20(1) may be received in the second shaft portion 24 as shown in FIGS. 1 to 7. A first end of the extension bar and the respective shaft locking device may then be fitted in the opposite end of the second shaft portion. The further second shaft portion would then receive the second, opposite, end of the extension bar and the respective locking device and the first shaft portion 20(2) and the locking device 18(2).

In the illustrated examples, the first shaft portion and the second shaft portion through-holes have a substantially rectangular cross-section with radiussed corners. Other non-circular cross-sections may be used. For example the cross-sections may be elliptical.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A wrench comprising a wrench head;

an extendable shaft comprising a first shaft portion and a second shaft portion;

a shaft locking device configured to be movable inwardly of said extendable shaft from a locking condition to a release condition in which telescoping of said second shaft portion is permitted;

wherein said locking device comprises a cylindrical member having a circumference and a series of teeth provided around said circumference;

said second shaft portion comprises respective tooth sets arranged in opposed spaced apart relationship; and wherein movement of said locking device from said release condition to bring teeth of said cylindrical member into engagement with teeth of said tooth sets puts said locking device in said locking condition so that telescoping of said second portion is prevented.

2. A wrench as claimed in claim 1, wherein said wrench head comprises an aperture to directly engage a workpiece.

3. A wrench as claimed in claim 1, wherein said wrench head comprises a formation configured to engage a complementary formation of a workpiece engaging member.

4. A wrench as claimed in claim 1, wherein said second shaft portion comprises an outer sleeve and an inner sleeve held in said outer sleeve and said first shaft portion is configured to be slideably received in said inner sleeve.

5. A wrench as claimed in claim 4, wherein said first shaft portion and said inner and outer sleeves each have a substantially non-circular cross-section configured such that in cross-section the first shaft portion in said inner sleeve and said inner sleeve in said outer sleeve forms a laminate structure.

6. A wrench as claimed in claim 4, wherein said first shaft portion has a housing for said locking device and said inner sleeve has a lengthways extending slot that has opposing sides that are provided with said tooth sets.

7. A wrench as claimed in claim 6, wherein said outer sleeve has a slot disposed over the slot of said inner sleeve and the locking device comprises an actuator portion that extends through both said slots to permit a user to press the locking device inwardly of said extendable shaft to move the locking device from said locking condition to said release condition.

8. A wrench as claimed in claim 7, wherein said locking device is operable to lock said extendable shaft in a substantially continuous range of extended positions over a length defined by said slot of said outer sleeve.

9. A wrench as claimed in claim 1, wherein said second shaft portion includes a slot and said locking device is operable to lock said extendable shaft in a substantially continuous range of positions over a length defined by said slot.

10. A wrench as claimed in claim 1, further comprising a biasing member disposed in said first shaft portion to bias said locking device to said locking condition.

11. A wrench comprising:

a wrench head;

an extendable shaft comprising a first shaft portion that extends from said wrench head and a second shaft portion that telescopes with respect to said first shaft portion;

a shaft locking device configured to move between a release condition and a locking condition to releasably lock said second shaft portion to said first shaft portion;

wherein said second shaft portion comprises an inner sleeve and an outer sleeve;

said first shaft portion is configured to be slideably received in said inner sleeve;

said inner sleeve has a lengthways extending slot that has opposite sides provided with respective series of locking formations extending along said slot to define a series of locking positions;

said shaft locking device comprises a cylindrical portion provided with locking formations to engage said series of locking formations provided on said inner sleeve at a said locking position to lock said second shaft portion to said first shaft portion to prevent said telescoping; and said shaft locking device has a longitudinal axis defining a lengthways direction of the locking device and is movable inwardly of the extendable shaft in said lengthways direction to move from said locking condition to said release condition.

12. A wrench as claimed in claim 11, wherein said first shaft portion and said inner and outer sleeves each have a substantially non-circular cross-section configured such that in cross-section the first shaft portion in said inner sleeve and said inner sleeve in said outer sleeve forms a laminate structure.

13. A wrench as claimed in claim 11, wherein said series of locking formations provided on said inner sleeve comprise series of teeth.

14. A wrench as claimed in claim 13, wherein said cylindrical portion has a circumference and said locking formations provided on said cylindrical portion comprise a series of teeth disposed around said circumference to engage with said series of teeth provided on said inner sleeve.

15. A wrench as claimed in claim 11, wherein said outer sleeve has a slot disposed over said slot of said inner sleeve and the locking device comprises an actuator portion that extends through both said slots to permit a user to press the locking device inwardly of said extendable shaft to move the locking device from said locking condition to said release condition.

16. A wrench as claimed in claim 15, wherein said locking device is operable to lock said extendable shaft in a substantially continuous range of extended positions over a length defined by said slot of said outer sleeve.

17. A wrench as claimed in claim 11, wherein said first shaft portion has a housing for said locking device and further comprising a biasing member disposed in housing to bias said locking device to said locking condition.

18. A wrench as claimed in claim 11, wherein at least one of said inner and outer sleeve comprises a folded metal sheet.

19. A wrench as claimed in claim 18, wherein said outer sleeve comprises a lengthways extending seam disposed opposite and spaced apart from said lengthways extending slot of said inner sleeve so that said seam abuts a contiguous surface of said inner sleeve.

20. A wrench as claimed in 11, wherein said locking device is configured to move between said locking and releasing conditions by a straight line movement in said lengthways direction.

* * * * *